United States Patent [19]

Hien et al.

[11] 4,009,610

[45] Mar. 1, 1977

[54] ROLL MOUNT FOR PLUG ROLLING MILL

[75] Inventors: Manfred Hien; Paul Schmitt, both of Saarbrucken, Germany

[73] Assignee: Mannesmann Aktiengesellschaft, Dusseldorf, Germany

[22] Filed: Apr. 30, 1976

[21] Appl. No.: 681,825

[30] Foreign Application Priority Data

May 22, 1975 Germany ..... 2523023

[52] U.S. Cl. ..... 72/209; 72/245

[51] Int. Cl.[2] ..... B21B 31/32; B21B 17/10; B21B 25/02

[58] Field of Search ..... 72/209, 237, 245, 208

[56] References Cited

UNITED STATES PATENTS 2,635,492 4/1953 Gettig ..... 72/209

*Primary Examiner*—Milton S. Mehr

*Attorney, Agent, or Firm*—Ralf H. Siegemund

[57] ABSTRACT

The upper one of a pair of grooved rolls is mounted on a carrier which is hydraulically biased in up direction but held down by a carriage acting as a lock and being pivotally suspended from a crossbeam of the roll stand. A hydraulic drive can retract the carriage laterally permitting the carrier to yield in up direction for exchanging the plug.

5 Claims, 3 Drawing Figures

ROLL MOUNT FOR PLUG ROLLING MILL

BACKGROUND OF THE INVENTION

The present invention relates to a plug rolling mill for pipes or tubes, and more particularly to structure for manufacturing of rolls in the roll stand.

Such a plug rolling mill may include two opposing grooved rolls one of which being adjustably mounted in the roll stand in relation to the other permitting a change in the axial distance between the rolls. Particularly, the upper one of the two rolls is mounted in that fashion and here particularly on a particularly constructed carrier and support which is adjustable in up and down direction. The upper roll must be lifted after each pass for removing the very hot plug or mandrel from the rod so that a new plug can be put in place for the next pass. Plug ejection and exchange have been automated to a considerable extent. The throughput of such a mill is actually largely determined by the speed of this plug changing process. Aside from the plug exchange proper, the up and down displacement of the upper roll prior to as well as subsequent to the plug change is an added delay.

DESCRIPTION OF THE INVENTION

It is an object of the present invention to provide a new and improved construction for changing the position of two grooved rolls in a plug rolling mill particularly for purposes of exchanging plugs in between passes.

It is a particular object of the present invention to improve the mounting of the upper one of a pair of rolls in a plug rolling mill permitting rather rapid up and down movement of the upper roll, while still developing several hundred tons of pressure to be reacted into the stand.

In accordance with the preferred embodiment of the present invention, it is suggested to mount one of the rolls of the pair of grooved rolls for a plug rolling mill in a carrier which is subjected to a hydraulic lowering and lifting and carries a laterally movable carriage which is retractable by another hydraulic drive from a position in which the carriage locks the carrier to the stand during rolling using a pivoted suspension mount as intermediate. Upon retraction of the carriage, the carrier is unlocked and can move the roll it carries away from the other roll in the stand. The hydraulic drive for the carrier is preferably continuously biased so that the carrier may yield immediately upon retraction of the carriage. The suspension mount is preferably pivoted to a crosshead or beam in the stand via a fine position or trim adjustment. The suspension mount is preferably constructed to include two side-by-side positioned, cylindrical rods whose axes are alighed with the axes of the rolls during rolling.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
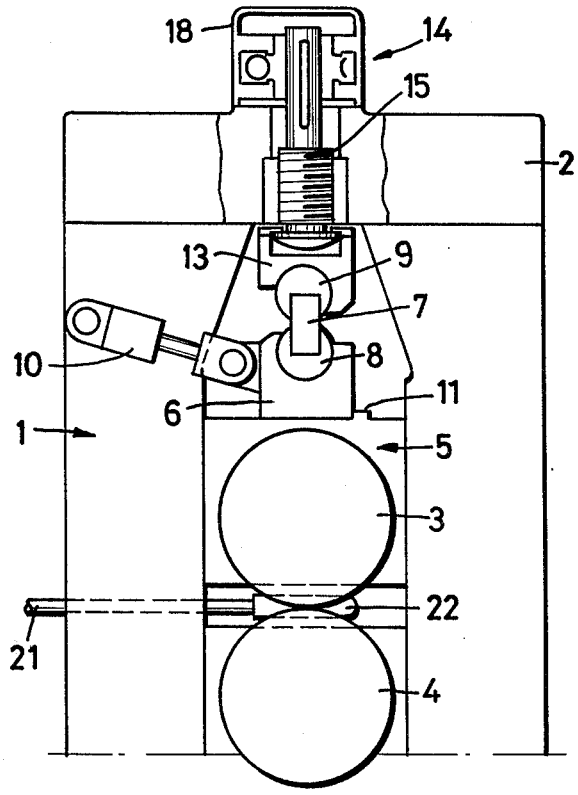
FIG. 1 is a sise view of a plug rolling mill improved in accordance with the preferred embodiment of the present invention.

Proceeding now to the detailed description of the drawings, the plug rolling mill as illustrated has a rolling stand and frame 1 with a crosshead, crossbeam or traverse 2. A lower roll 4 is journalled in suitable bearings in the frame and in a conventional manner. The axis of the roll 4 remains stationary. An upper roll 3 is journalled in suitable bearings in a carrier 5 which is disposed for up and down movement in frame 1.

The carrier 5 carries a carriage 6 which moves in the transverse direction but parallely to the direction of rolling, the movement being made possible on top of carrier 5. Carriage 6 is connected to the crossbeam 2 by means of a pivotal suspension mount 7. Mount 7 includes two cylindrical rods 8 and 9 which extend parallel to each other and are respectively held in bearings in the carriage 6 on the one hand, and in a particular support 13 pertaining to and being associated with crossbeam 2, on the other hand. The suspension mount 7 can pivot about the axes of either rod and the suspension can therefore also be construed as a kind of double-hinged, pivot mount.

A double acting or reversible hydraulic drive 10 having, piston and piston rod is pivotally linked to the frame 1 as well as to the carriage 6. Drive 10 could be linked to the carrier 5 instead of frame 1. Normally, the hydraulic drive 10 urges carriage 6 against a stop 11 on the upper roll carrier 5. The drive 10 can reverse to retract the carriage from that stop, whereby the pivoted suspension mount pivots on both its pivot axes.

Figure 2:
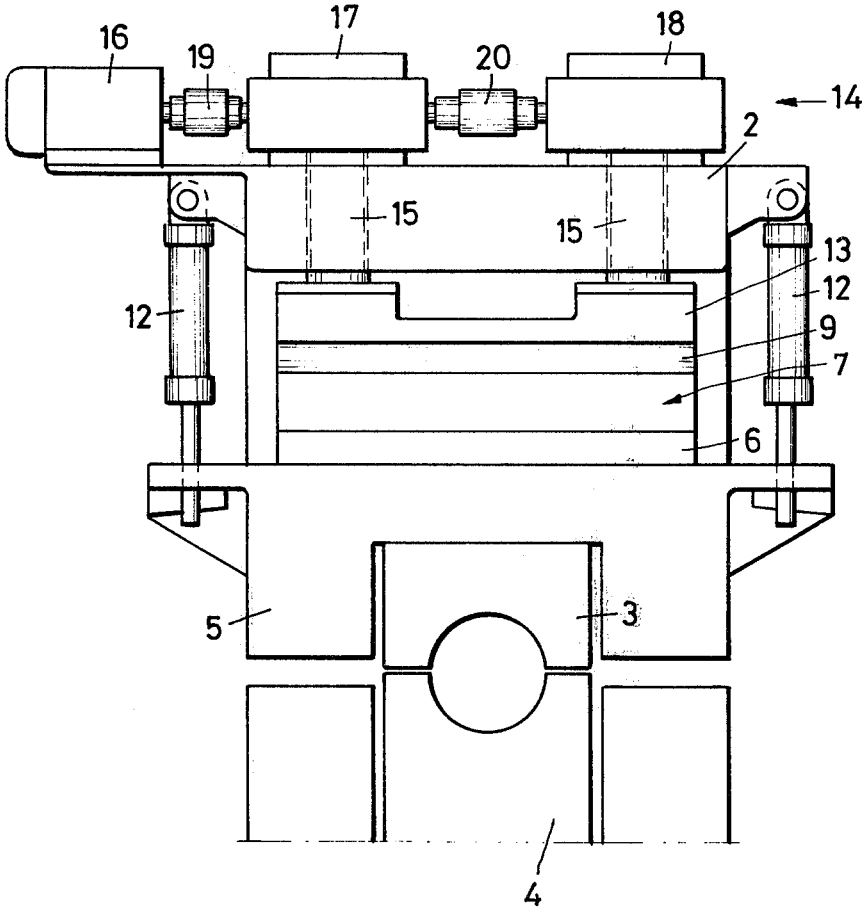
FIG. 2 is a front view of the mill shown in FIG. 1 and as seen in the direction of rolling.

Two hydraulic drives 12 are disposed for lifting and lowering the carrier 5. For this drives 12 have their upper ends pivotally linked to extensions of the crossbeam 2 as can be seen best in FIG. 2. The piston rods of the drives are secured to lateral extensions of the roll carrier 5. This way roll carrier and the upper roll 3 can be raised and lowered by means of these hydraulic drives.

For trimming the adjustment position of the upper roll, additional elements, collectively denoted by reference numeral 14, are provided in association with the carrier 5. This fine position adjustment device includes an electromotor 16 on top of the crossbar 2 and is coupled to a first adjustment gear 17 via a coupling 19. An additional coupling 20 couples the motor to a second adjustment gear 18. The two gears 17 and 18 operate drive spindles 15 for lowering and lifting the element 13. This particular adjustment device is used only for adjusting the axes of the rolls to each other to match the spacing to a particular diameter of the pipe to be rolled. Thus, the adjustment range is rather small particularly as compared with the lifting stroke provided by the drive 12.

During rolling (FIG. 1) hydraulic drive 10 urges and continues to urge carriage 6 against stop 11 and thus establishes an operating state in which the suspension mount 7 is oriented in vertical direction. Accordingly the two rods 8 and 9 have their axes coinciding with the plane defined by the axes of the two rolls 3 and 4. Thus, rolling pressure is provided into and through the suspension mount in straight through direction so that the rolling and reaction forces can be reacted directly into the crossbeam 2. The hydraulic drive 10 is not subjected to any forces resulting from the rolling nor to any forces as provided by the hydraulic drives 12.

Figure 3:
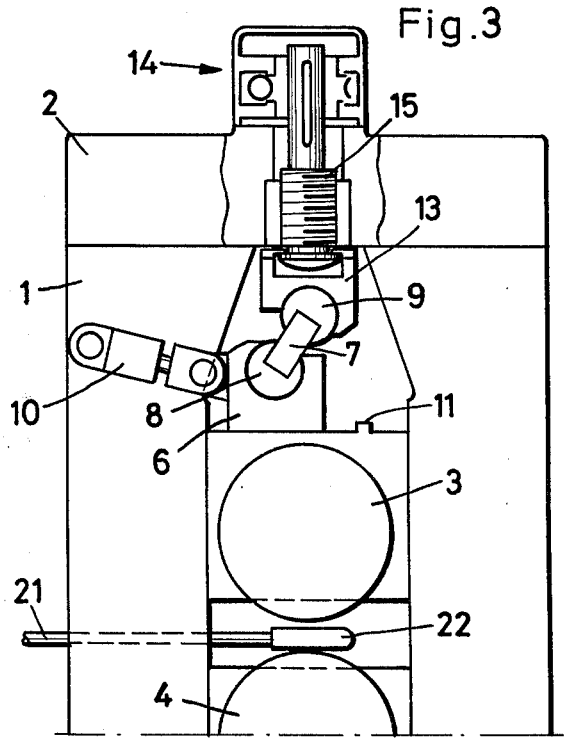
FIG. 3 is side view similar to FIG. 1 but with lifted upper roll.

The hydraulic drives 12 are biased to continuously urge the carrier 5 in up direction but mount 7 and carriage 6 lock the carrier 5 in position. Upon actuating drive 10 in the reverse, carriage 6 is retracted from the stop 11 and into a position as shown in FIG. 3. Drives 12 are now enabled to pull the carrier 5 up causing the pivot mount 7 to tilt accordingly. The double hinge or pivot action of the mount 7 is needed here because carriage 6 remains parallel on carrier 5. Drives 12 are sufficiently strong to accelerate the carrier 5 at a relatively high rate so that it can move up at about the same rate that the much lighter carriage 6 is retracted laterally and is swung up by the pivot mount.

As soon as the upper roll 3 has been lifted, the plug 22 can be exchanged in the usual fashion and upon completion of the plug exchange, drive 10 reverses again and forces carriage 6 forward whereby a large force by a bent lever action forces the carriage 6 and carrier 5 down, again overcoming the up bias of drives 12. The resulting parallelogram of forces permits a relatively small force on carriage 6 by operation of drive 10, to exert a very large force upon carrier 5 and in down direction.

The bias of drive 12, therefore, has the advantage that the upstroke of carrier 5 begins immediately upon retraction of the carriage 6 as stated above. The rapid up movement of carrier 5 as well as its return to a rolling position materially reduces the delay between passes and shortens the overall period for plug exchange. Also, the permanent bias of and by drives 12 eliminates any play in the machine particularly during rolling so that the various parts cannot and will not shift or move relative to each other.

The invention is not limited to the embodiments described above but all changes and modifications thereof not constituting departures from the spirit and scope of the invention are intended to be included.

We claim:

1. In a plug rolling mill having a stand and a pair of grooved rolls the improvement comprising in combination:

a carrier for one of the rolls of the pair disposed for up and down movement in the stand;

first hydraulic means coupled to the carrier and to the stand for holding said carrier in vertically variable positions in relation to the other one of the rolls of the pair;

a carriage laterally movably disposed on the carrier;

second hydraulic means coupled to the stand and to the carriage for reciprocating the carriage on the carrier;

a pivotal mount for said carriage holding the carriage against the carrier in a first, protracted position of the second drive thereby urging the carrier and the one roll into a particular operating positon, the mount permitting said carrier to yield in a direction away from said other roll upon retraction of the carriage by the second drive from the first position; and means for mounting said mount to said stand so that forces acting on the carrier during rolling are being reacted through the carriage and the mount into the stand.

2. In a mill as in claim 1, said mount including first and second cylindrical rods placed side by side and being interconnected, the rods being respectively journalled in the carriage and in the means for mounting, the axes of the bolts being located in the same plane as the axes of the rolls during rolling.

3. In a mill as in claim 2, and including a stop on the carriage, said first drive urging said carriage against said stop whereby the axes of said rods are located in said plane.

4. In a mill as in claim 1, said first hydraulic means being continuously biased.

5. In a mill as in claim 1, said means for mounting including means for trim adjusting the disposition of the carrier during rolling.

* * * * *